US007963617B2

(12) United States Patent
Hall et al.

(10) Patent No.: US 7,963,617 B2
(45) Date of Patent: Jun. 21, 2011

(54) DEGRADATION ASSEMBLY

(75) Inventors: David R. Hall, Provo, UT (US); Ronald B. Crockett, Payson, UT (US); Scott Dahlgren, Alpine, UT (US)

(73) Assignee: Schlumberger Technology Corporation, Houston, TX (US)

( * ) Notice: Subject to any disclaimer, the term of this patent is extended or adjusted under 35 U.S.C. 154(b) by 271 days.

(21) Appl. No.: 12/051,689

(22) Filed: Mar. 19, 2008

(65) Prior Publication Data

US 2008/0164072 A1 Jul. 10, 2008

Related U.S. Application Data

(63) Continuation of application No. 12/051,586, filed on Mar. 19, 2008, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, which is a continuation of application No. 11/965,672, filed on Dec. 27, 2007, which is a continuation-in-part of application No. 11/686,831, filed on Mar. 15, 2007, now Pat. No. 7,568,770.

(51) Int. Cl.
*E21C 35/197* (2006.01)

(52) U.S. Cl. ..... 299/113; 175/432

(58) Field of Classification Search ..... 299/113, 299/111, 104, 107; 175/327, 428, 432
See application file for complete search history.

(56) References Cited

U.S. PATENT DOCUMENTS

| | | | | |
|---|---|---|---|---|
| 2,004,315 | A | 6/1935 | Fean | |
| 2,124,438 | A | 7/1938 | Struk | |
| 3,254,392 | A | 6/1966 | Novkov | |
| 3,342,531 | A * | 9/1967 | Krekeler | 299/107 |
| 3,746,396 | A | 7/1973 | Radd | |
| 3,807,804 | A | 4/1974 | Kniff | |
| 3,830,321 | A | 8/1974 | McKenry | |
| 3,932,952 | A | 1/1976 | Helton | |
| 3,945,681 | A | 3/1976 | White | |
| 4,005,914 | A | 2/1977 | Newman | |
| 4,006,936 | A | 2/1977 | Crabiel | |
| 4,098,362 | A | 7/1978 | Bonnice | |
| 4,109,737 | A | 8/1978 | Bovenkerk | |
| 4,149,753 | A | 4/1979 | Stoltz et al. | |
| 4,156,329 | A | 5/1979 | Daniels | |
| 4,199,035 | A | 4/1980 | Thompson | |
| 4,201,421 | A | 5/1980 | Den Besten | |
| 4,277,106 | A | 7/1981 | Sahley | |
| 4,439,250 | A | 3/1984 | Acharya | |

| | | | | |
|---|---|---|---|---|
| 4,465,221 | A | 8/1984 | Acharya | |
| 4,484,644 | A | 11/1984 | Cook | |
| 4,489,986 | A | 12/1984 | Dziak | |
| 4,678,237 | A | 7/1987 | Collin | |
| 4,682,987 | A | 7/1987 | Brady | |
| 4,688,856 | A | 8/1987 | Elfgen | |
| 4,725,098 | A | 2/1988 | Beach | |
| 4,729,603 | A | 3/1988 | Elfgen | |
| 4,765,686 | A | 8/1988 | Adams | |
| 4,765,687 | A | 8/1988 | Parrott | |
| 4,776,862 | A | 10/1988 | Wiand | |
| 4,880,154 | A | 11/1989 | Tank | |
| 4,932,723 | A | 6/1990 | Mills | |
| 4,940,288 | A | 7/1990 | Stiffler | |
| 4,944,559 | A | 7/1990 | Sionnet | |
| 4,951,762 | A | 8/1990 | Lundell | |
| 5,011,515 | A | 4/1991 | Frushour | |
| 5,112,165 | A | 5/1992 | Hedlund | |
| 5,141,289 | A | 8/1992 | Stiffler | |
| 5,154,245 | A | 10/1992 | Waldenstrom | |
| 5,186,892 | A | 2/1993 | Pope | |
| 5,251,964 | A | 10/1993 | Ojanen | |
| 5,261,499 | A | 11/1993 | Grubb | |
| 5,332,348 | A | 7/1994 | Lemelson | |
| 5,417,475 | A | 5/1995 | Graham | |
| 5,447,208 | A | 9/1995 | Lund | |
| 5,535,839 | A | 7/1996 | Brady | |
| 5,542,993 | A | 8/1996 | Rabinkin | |
| 5,653,300 | A | 8/1997 | Lund | |
| 5,738,698 | A | 4/1998 | Kapoor | |
| 5,823,632 | A | 10/1998 | Burkett | |
| 5,837,071 | A | 11/1998 | Andersson | |
| 5,842,747 | A | 12/1998 | Winchester | |
| 5,845,547 | A | 12/1998 | Sollami | |
| 5,875,862 | A | 3/1999 | Jurewicz | |
| 5,934,542 | A | 8/1999 | Nakamura | |
| 5,935,718 | A | 8/1999 | Demo | |
| 5,944,129 | A | 8/1999 | Jensen | |
| 5,967,250 | A | 10/1999 | Lund | |
| 5,992,405 | A | 11/1999 | Sollami | |
| 6,006,846 | A | 12/1999 | Tibbitts | |
| 6,019,434 | A | 2/2000 | Emmerich | |
| 6,044,920 | A | 4/2000 | Massa | |
| 6,051,079 | A | 4/2000 | Andersson | |
| 6,056,911 | A | 5/2000 | Griffin | |
| 6,065,552 | A | 5/2000 | Scott | |
| 6,113,195 | A | 9/2000 | Mercier | |
| 6,170,917 | B1 | 1/2001 | Heinrich | |
| 6,193,770 | B1 | 2/2001 | Sung | |
| 6,196,636 | B1 | 3/2001 | Mills | |
| 6,196,910 | B1 | 3/2001 | Johnson | |
| 6,199,956 | B1 | 3/2001 | Kammerer | |
| 6,216,805 | B1 | 4/2001 | Lays | |
| 6,270,165 | B1 | 8/2001 | Peay | |
| 6,341,823 | B1 | 1/2002 | Sollami | |
| 6,354,771 | B1 | 3/2002 | Bauschulte | |
| 6,364,420 | B1 | 4/2002 | Sollami | |
| 6,371,567 | B1 | 4/2002 | Sollami | |
| 6,375,272 | B1 | 4/2002 | Ojanen | |
| 6,419,278 | B1 | 7/2002 | Cunningham | |
| 6,478,383 | B1 | 11/2002 | Ojanen | |
| 6,499,547 | B2 | 12/2002 | Scott | |
| 6,517,902 | B2 | 2/2003 | Drake | |
| 6,585,326 | B2 * | 7/2003 | Sollami | 299/104 |
| 6,685,273 | B1 | 2/2004 | Sollami | |
| 6,692,083 | B2 | 2/2004 | Latham | |
| 6,709,065 | B2 | 3/2004 | Peay | |
| 6,719,074 | B2 | 4/2004 | Tsuda | |
| 6,733,087 | B2 | 5/2004 | Hall | |
| 6,739,327 | B2 | 5/2004 | Sollami | |
| 6,758,530 | B2 | 7/2004 | Sollami | |
| 6,786,557 | B2 | 9/2004 | Montgomery, Jr. | |
| 6,824,225 | B2 | 11/2004 | Stiffler | |
| 6,851,758 | B2 | 2/2005 | Beach | |
| 6,854,810 | B2 | 2/2005 | Montgomery, Jr. | |
| 6,861,137 | B2 | 3/2005 | Griffin | |
| 6,889,890 | B2 | 5/2005 | Yamazaki | |
| 6,966,611 | B1 | 11/2005 | Sollami | |
| 6,994,404 | B1 | 2/2006 | Sollami | |
| 7,204,560 | B2 | 4/2007 | Mercier | |
| 2002/0175555 | A1 | 11/2002 | Mercier | |
| 2003/0140350 | A1 | 7/2003 | Noro | |
| 2003/0209366 | A1 | 11/2003 | McAlvain | |
| 2003/0234280 | A1 | 12/2003 | Cadden | |
| 2004/0026983 | A1 * | 2/2004 | McAlvain | 299/111 |
| 2004/0065484 | A1 | 4/2004 | McAlvain | |
| 2005/0159840 | A1 | 7/2005 | Lin | |
| 2005/0173966 | A1 | 8/2005 | Mouthaan | |
| 2006/0237236 | A1 | 10/2006 | Sreshta | |

FOREIGN PATENT DOCUMENTS

| | | |
|---|---|---|
| DE | 3500261 | 7/1986 |
| DE | 3818213 | 11/1989 |
| DE | 4039217 | 6/1992 |
| DE | 19821147 | 11/1999 |
| DE | 10163717 | 5/2003 |
| EP | 0295151 | 12/1988 |
| EP | 0412287 | 2/1991 |
| GB | 2004315 | 3/1979 |
| GB | 2037223 | 7/1980 |
| JP | 5280273 A | 10/1993 |

* cited by examiner

*Primary Examiner* — John Kreck
(74) *Attorney, Agent, or Firm* — Holme Roberts & Owen LLP

(57) ABSTRACT

A degradation assembly for use with a driving mechanism includes a working portion coupled to a shank assembly. The working portion has an impact tip brazed to a working end of a carbide extension. The carbide extension has a cavity formed in a base end that is adapted to engage with a shank and a locking mechanism of the shank assembly. The shank has an outer surface proximate a first end which is receivable within the cavity of the carbide extension. The locking mechanism has a radially extending catch configured to engage with the cavity and couple the shank assembly to the working portion. The shank has an outer surface proximate a second end which is adapted to be press-fitted within a recess of a driving mechanism.

21 Claims, 11 Drawing Sheets

DEGRADATION ASSEMBLY

RELATED APPLICATIONS

This application is a continuation-in-part of U.S. patent application Ser. No. 12/051,586, filed on Mar. 19, 2008, which is a continuation-in-part of U.S. patent application Ser. No. 12/021,051, filed on Jan. 28, 2008, which is a continuation of U.S. patent application Ser. No. 12/021,019, filed on Jan. 28, 2008, which is a continuation-in-part of U.S. patent application Ser. No. 11/971,965, filed on Jan. 10, 2008, now U.S. Pat. No. 7,648,210, which is a continuation of U.S. patent application Ser. No. 11/947,644, filed on Nov. 29, 2007, which is a continuation-in-part of U.S. patent application Ser. No. 11/844,586, filed on Aug. 24, 2007, now U.S. Pat. No. 7,600,823. U.S. patent application Ser. No. 11/844,586 is a continuation-in-part of U.S. patent application Ser. No. 11/829,761, filed on Jul. 27, 2007, now U.S. Pat. No. 7,722,127. U.S. patent application Ser. No. 11/829,761 is a continuation in-part of U.S. patent application Ser. No. 11/773,271, filed on Jul. 3, 2007. U.S. patent application Ser. No. 11/773,271 is a continuation-in-part of U.S. patent application Ser. No. 11/766,903, filed on Jun. 22, 2007. U.S. patent application Ser. No. 11/766,903 is a continuation of U.S. patent application Ser. No. 11/766,865, filed on Jun. 22, 2007. U.S. patent application Ser. No. 11/766,865 is a continuation-in-part of U.S. patent application Ser. No. 11/742,304, filed on Apr. 30, 2007, now U.S. Pat. No. 7,475,948. U.S. patent application Ser. No. 11/742,304 is a continuation of U.S. patent application Ser. No. 11/742,261, filed on Apr. 30, 2007, now U.S. Pat. No. 7,469,971. U.S. patent application Ser. No. 11/742,261 is a continuation-in-part of U.S. patent application Ser. No. 11/464,008, filed on Aug. 11, 2006, now U.S. Pat. No. 7,338,135. U.S. patent application Ser. No. 11/464,008 is a continuation-in-part of U.S. patent application Ser. No. 11/463,998, filed on Aug. 11, 2006, now U.S. Pat. No. 7,384,105. U.S. patent application Ser. No. 11/463,998 is a continuation-in-part of U.S. patent application Ser. No. 11/463,990, filed on Aug. 11, 2006, now U.S. Pat. No. 7,320,505. U.S. patent application Ser. No. 11/463,990 is a continuation-in-part of U.S. patent application Ser. No. 11/463,975, filed on Aug. 11, 2006, now U.S. Pat. No. 7,445,294. U.S. patent application Ser. No. 11/463,975 is a continuation-in-part of U.S. patent application Ser. No. 11/463,962, filed on Aug. 11, 2006, now U.S. Pat. No. 7,413,256. U.S. patent application Ser. No. 11/463,962 is a continuation-in-part of U.S. patent application Ser. No. 11/463,953, filed on Aug. 11, 2006, now U.S. Pat. No. 7,464,993. The present application is also a continuation-in-part of U.S. patent application Ser. No. 11/695,672, filed on Dec. 27, 2007. U.S. patent application Ser. No. 11/695,672 is a continuation-in-part of U.S. patent application Ser. No. 11/686,831, filed on Mar. 15, 2007, now U.S. Pat. No. 7,568,770. All of these applications are herein incorporated by reference for all that they contain.

BACKGROUND OF THE INVENTION

This invention relates to drill bits, specifically drill bit assemblies for use in oil, gas and geothermal drilling. More particularly, the invention relates to cutting elements in drill bits comprised of a carbide substrate with an abrasion resistant layer of superhard material.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the superhard abrasive layer or the substrate thereby reducing or eliminating the cutting elements efficacy and decreasing overall drill bit wear life. The superhard material layer of a cutting element sometimes delaminates from the carbide substrate after the sintering process as well as during percussive and abrasive use. Damage typically found in drag bits may be a result of shear failures, although non-shear modes of failure are not uncommon. The interface between the super hard material layer and substrate is particularly susceptible to non-shear failure modes due to inherent residual stresses.

U.S. Pat. No. 6,332,503 by Pessier et al., which is herein incorporated by reference for all that it contains, discloses an array of chisel-shaped cutting elements are mounted to the face of a fixed cutter bit. Each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al., which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary bit for rock drilling comprising a plurality of cutting elements mounted by interference-fit in recesses in the crown of the drill bit. Each cutting element comprises an elongated pin with a thin layer of polycrystalline diamond bonded to the free end of the pin.

U.S. Patent Application Serial No. 2001/0004946 by Jensen, although now abandoned, is herein incorporated by reference for all that it discloses. Jensen teaches that a cutting element or insert with improved wear characteristics while maximizing the manufacturability and cost effectiveness of the insert. This insert employs a superabrasive diamond layer of increased depth and by making use of a diamond layer surface that is generally convex.

BRIEF SUMMARY OF THE INVENTION

In one aspect of the invention, a degradation assembly has a working portion coupled to a shank assembly. The working portion has an impact tip brazed to a working end of a carbide extension. The carbide extension has a cavity formed in a base end which is adapted to interlock with the shank and locking mechanism of the shank assembly. The shank has a first outer surface proximate a first end which is receivable within the cavity. A second outer surface proximate the second end of the shank is adapted to be press-fitted within a recess of a driving mechanism. The locking mechanism is slidably supported within a bore of the shank and includes a locking head projecting from the first end of the shank having a radially-extending catch configured to engage with the cavity, and a locking shaft extending away from the locking head towards the second end of the shank. The shank may have a coefficient of thermal expansion which is 110 percent or more than a coefficient of thermal expansion of the material of the driving mechanism.

The cavity may have an inwardly-protruding lip or catch. The inwardly-protruding catch may be adapted to engage with the radially-extending catch of the locking head. An insert may be positioned between the inwardly-protruding catch and the radially-extending catch. The insert may be a ring, a snap ring, a split ring, or a flexible ring. The insert may also be a plurality of balls, wedges, shims or combinations thereof. The insert may be a spring.

The locking mechanism may have a locking shaft extending away from the locking head towards the second end of the shank, which locking shaft is mechanically associated with a tensioning mechanism positioned adjacent the bore and proximate the second end of the shank. Activating the tensioning mechanism may apply tension along a length of the locking shaft. The locking mechanism may have a coefficient of thermal expansion equal to or less than the coefficient of thermal expansion of the shank. The shank assembly may be formed from hardened materials such as steel, stainless steel, hardened steel, or other materials of similar hardness.

The impact tip may comprise a superhard material bonded to a cemented metal carbide substrate at a non-planar interface. The cemented metal carbide substrate may be brazed to the carbide extension. The cemented metal carbide substrate may have the same coefficient of thermal expansion as the carbide extension. The cemented metal carbide substrate may have a thickness of 0.30 to 0.65 times a thickness of the superhard material. One or more impact tips may be brazed to the carbide extension.

The degradation assembly may be incorporated in drill bits, shear bits, percussion bits, roller cone bits or combinations thereof. The degradation assembly may also be incorporated in mining picks, trenching picks, asphalt picks, excavating picks or combinations thereof. The carbide extension may comprise a drill bit blade, a drill bit working surface, a pick bolster, or combinations thereof.

DETAILED DESCRIPTION OF EXEMPLARY EMBODIMENTS

Figure 1:
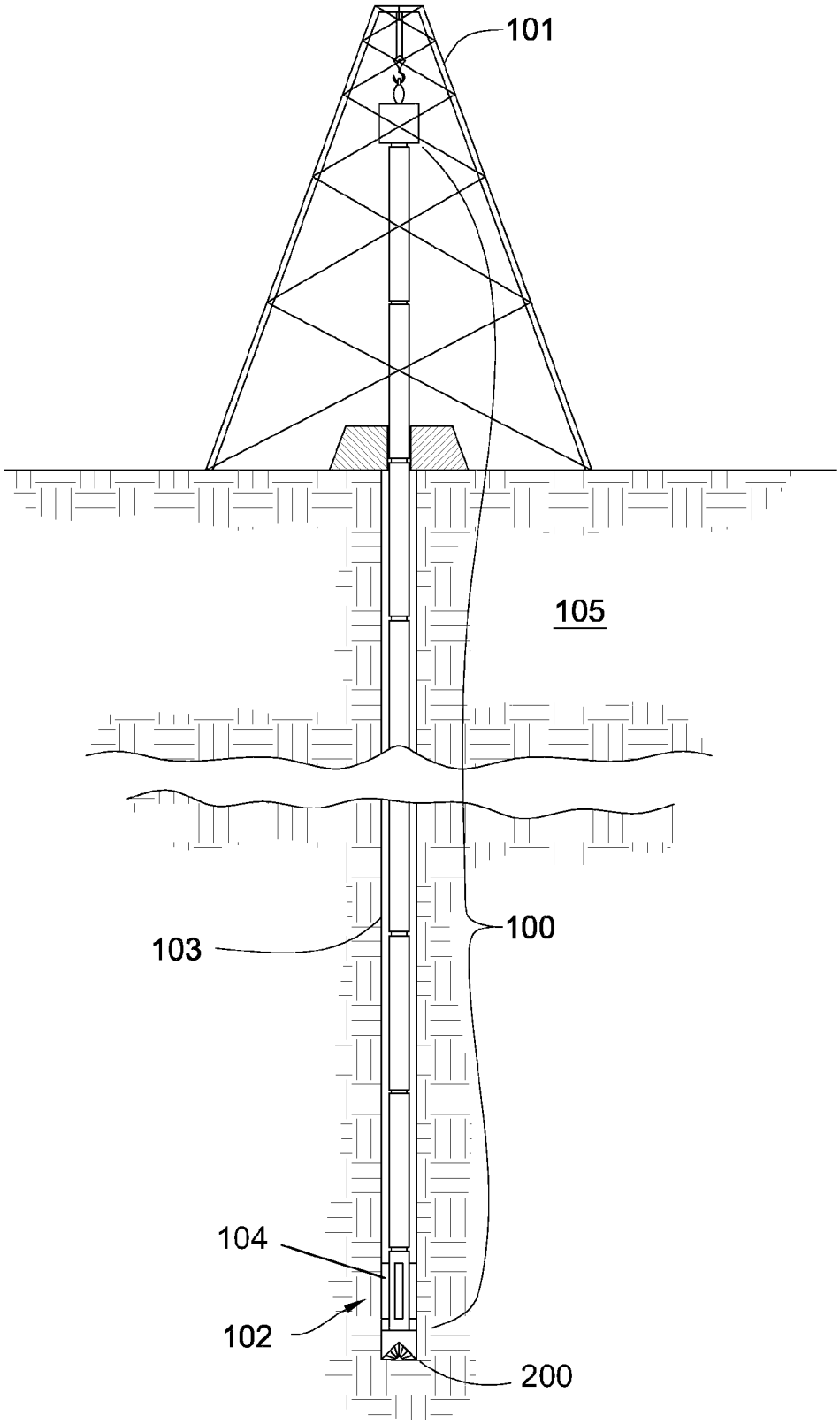
FIG. 1 is a perspective diagram of an embodiment of a drill string suspended in a bore hole.

Referring now to the figures, FIG. 1 is a cross-sectional diagram of an embodiment of a drill string 100 suspended by a derrick 101. A bottom-hole assembly 102 is located at the bottom of a bore hole 103 and comprises a bit 200 and a stabilizer assembly 104. As the drill bit 200 rotates down hole the drill string 100 advances farther into the earth. The drill string 100 may penetrate soft or hard subterranean formations 105.

Figure 2:
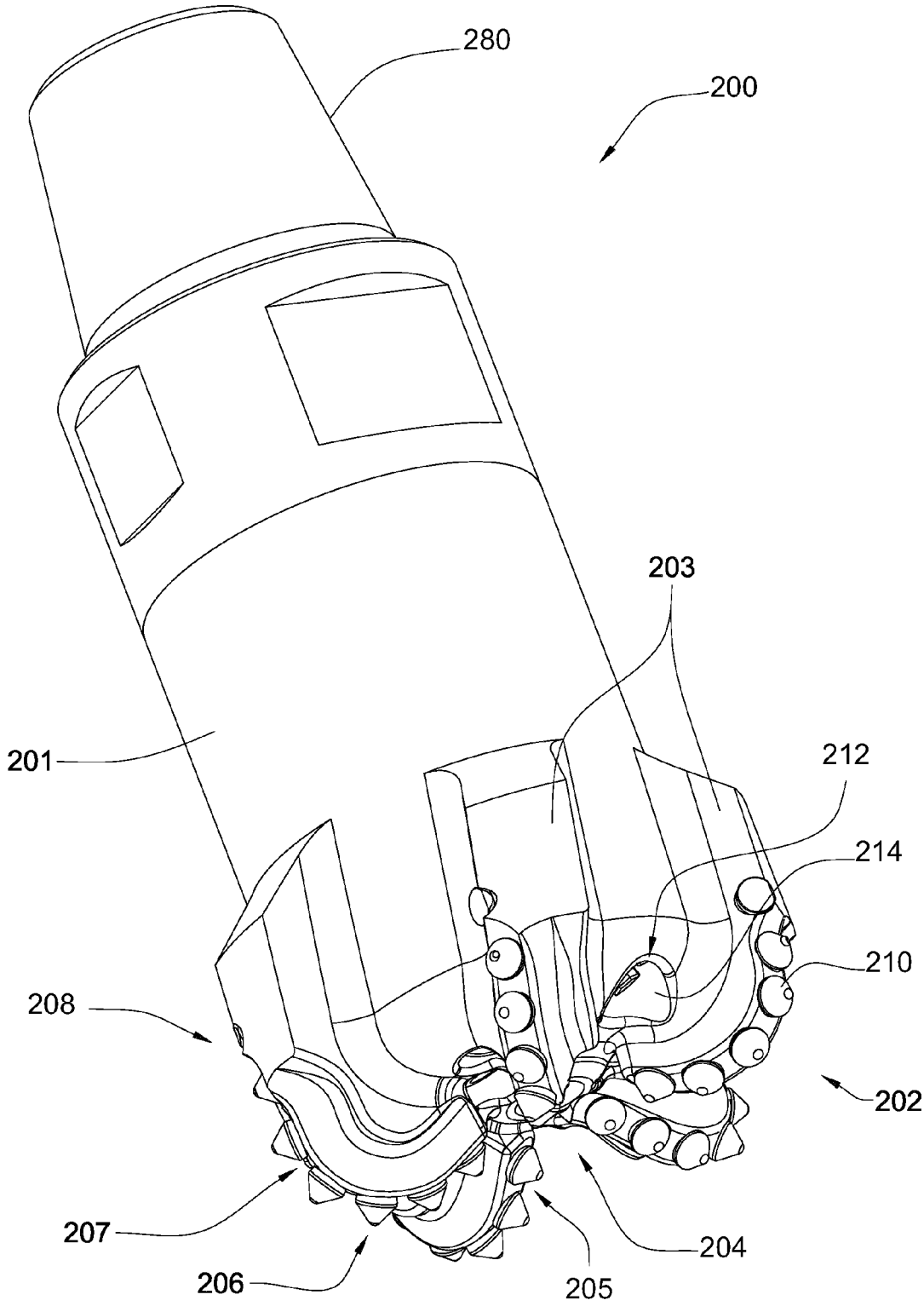
FIG. 2 is a perspective diagram of an embodiment of a rotary drag bit.

FIG. 2 discloses an embodiment wherein the drill bit 200 may be a rotary drag bit. The drill bit 200 comprises a shank 280 which is adapted for connection to the drill string. In some embodiments coiled tubing or other types of tool string may be used. The drill bit 200 of the present invention is intended for deep oil and gas drilling, although any type of drilling application is anticipated such as horizontal drilling, geothermal drilling, mining, exploration, on and off-shore drilling, directional drilling, water well drilling and any combination thereof. The bit body 201 is attached to the shank 280 and comprises an end which forms a working face 202.

Several blades 203 extend outwardly from the bit body 201, each of which may include a plurality of cutting elements or inserts 210. A drill bit 200 most suitable for the present invention may have at least three blades 203; preferably the drill bit 200 will have between three and seven blades 203. The blades 203 collectively form an inverted conical region 204. Each blade 203 may have a cone portion 205, a nose portion 206, a flank portion 207, and a gauge portion 208. Cutting inserts 210 may be arrayed along any portion of the blades 203, including the cone portion 204, nose portion 206, flank portion 207, and gauge portion 208.

212 are fitted into recesses 214 formed in the working face 202. Each nozzle 212 may be oriented such that a jet of drilling mud ejected from the nozzles 212 engages the formation before or after the cutting elements 210. The jets of drilling mud may also be used to clean cuttings away from the working face 202 of the drill bit 200. In some embodiments, the jets may be used to create a sucking effect to remove drill bit cuttings adjacent the cutting elements or inserts 210 by creating a low pressure region within their vicinities.

Figure 3:
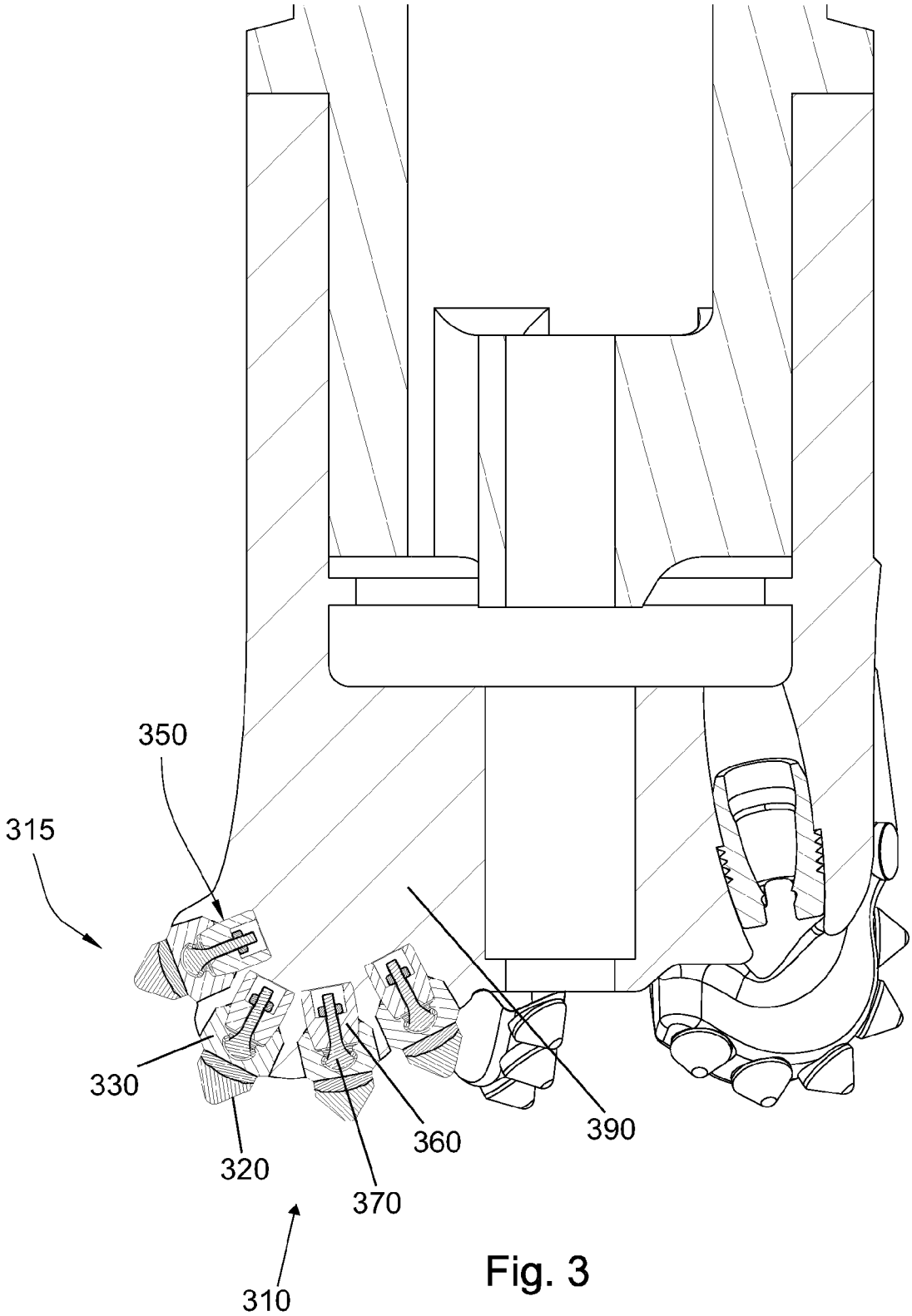
FIG. 3 is a cross-sectional diagram of another embodiment of a rotary drag bit.

Referring now to FIG. 3, the cutting insert may be a degradation assembly 310. The degradation assembly 310 comprises a working portion 315 coupled to a shank assembly 350. The working portion 315 may comprise an impact tip 320 that is brazed to a cemented metal carbide extension 330. The shank assembly 350 may comprise a shank 360 and a locking mechanism 370 that is slidably supported within a bore of the shank. The locking mechanism 370 operates to couple one end of the shank 360 into the carbide extension 330. The other end of the shank 360 opposite the working portion 315 can be attached to a drive mechanism 390 with a press fit.

Figure 4:
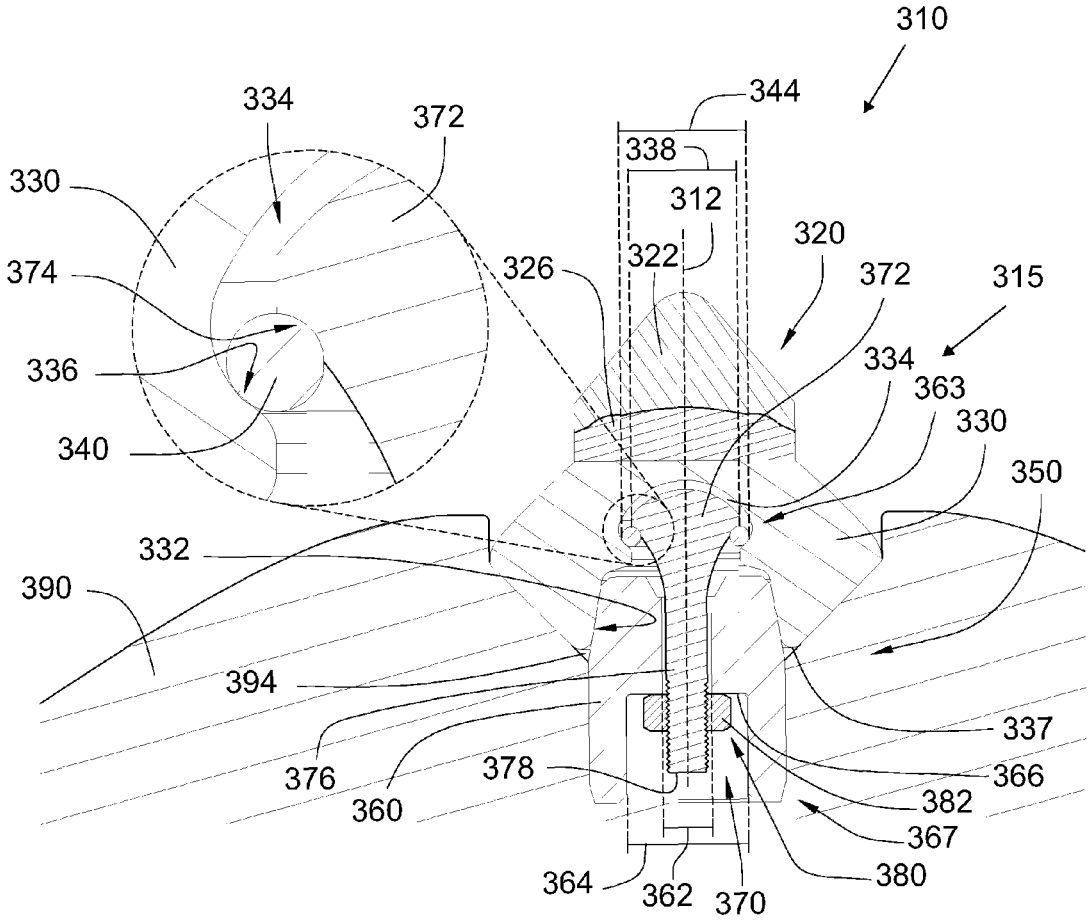
FIG. 4 is a cross-sectional diagram of an embodiment of a degradation assembly.

As illustrated with greater detail in FIG. 4, the impact tip 320 comprises a tip of superhard material 322 bonded to a cemented metal carbide substrate 326 to form the impact tip 320, which may then be attached to the working end of the carbide extension 330 opposite a base end 337. The carbide extension 330 may comprise tungsten, titanium, tantalum, molybdenum, niobium, cobalt and/or combinations thereof.

The carbide extension 330 is adapted to engage or interlock with the shank assembly 350. For instance, the carbide extension 330 of degradation assembly 310 includes an extension cavity 334 opening inwardly from the base end 337.

The shank assembly 350 may comprise a shank 360 having a first end 363 and a second end 367, and with a locking mechanism 370 projecting outwardly from the first end 363 of the shank 360. The first end 363 of the shank 360 may be adapted to fit into the extension cavity 334 formed into the base end 337 of the carbide extension 330. In the embodiment of the degradation assembly 310 illustrated in FIGS. 3 and 4, the shank 360 is generally cylindrical. The second end 367 of the shank 360 is press-fitted into a recess 394 of the driving mechanism 390, which can comprise the drill bit blade 203 or bit body 201 illustrated in FIG. 2.

components of the shank assembly 350 may be formed from a hardened material such as steel, stainless steel, hardened steel, or other materials of similar hardness. The components of the shank assembly 350 may also be work-hardened or cold-worked in order to provide resistance to cracking or stress fractures due to forces exerted on the degradation assembly 310 by a formation, such as the formation 105 illustrated in FIG. 1. In an exemplary embodiment, the components of the shank assembly 350 may be work-hardened by shot-peening or by other methods of work-hardening. At least a portion of the shank assembly 350 may also be work-hardened by stretching it during the manufacturing process.

The shank assembly 350 comprises a shank 360 and a locking mechanism 370. The locking mechanism 370 may be slidably supported within a bore 362 of the shank, and includes a locking head 372 projecting from the first end 363 of the shank 360. The locking mechanism 370 may also include a locking shaft 376 that is axially disposed within the bore 362 of the shank 360 and extending away from the locking head 372 towards the second end 367 of the shank 360. The exposed end 378 of the locking shaft 376 opposite the locking head 372 and proximate the second end 367 of the shank 360 is secured within or below the bore 362, such as with a tensioning mechanism 380 or lock located within a shank cavity 364 that opens inwardly from the second end 367 of the shank.

The first end 363 of the shank 360 can be sized and shaped for insertion into the extension cavity 334 formed into the base end 337 of the carbide extension 330, so that locking head 372 of the locking mechanism 370 projects into the extension cavity 334 upon assembly of the shank assembly 350 to the working portion 315. As shown in the expanded section of FIG. 4, the locking head 372 of the locking mechanism 370 includes a radially-extending catch 374 that is configured to engage with an inwardly-protruding lip or catch 336 of the extension cavity 334. Thus, the locking mechanism 370 is adapted to couple the first end 363 of the shank 360 within the carbide extension's extension cavity 334 and restrict movement of the shank assembly 350 with respect to the carbide extension 330. For example, the working portion 315 may be prevented by the locking mechanism 370 from moving in a direction parallel to a longitudinal central axis 312 of the shank 360 or degradation assembly 310. In some embodiments the working portion 315 may be prevented by the locking mechanism 370 from rotating about the central axis 312.

in FIG. 4, the extension cavity 334 comprises an inwardly protruding lip or catch 336. An insert 340 is disposed intermediate the inwardly-protruding catch 336 of the cavity 330 and the radially-extending catch 374 of the locking head 372. The insert 340 may comprise stainless steel. In some embodiments the insert 340 may comprise an elastomeric material and may be flexible. In other embodiments the insert 340 may be a ring, a snap ring, a split ring, coiled ring, a rigid ring, a flexible ring, segments, balls, wedges, shims, a spring, or combinations thereof.

Also shown in FIG. 4, the locking mechanism 370 comprises a locking shaft 376 extending away from the locking head 372. In some embodiments the radially-extending catch 374 is an undercut formed in the locking head 372. The insert 340 and locking head 372 are disposed within the cavity 334 of the carbide extension 330. The locking shaft 376 extends away from the locking head 372 and is disposed within the bore 362 proximate the first end 363 of the shank 360, and adapted for translation in a direction parallel to the central axis 402 of the degradation assembly 310.

locking head 372 of the locking mechanism 370 is inserted into the extension cavity 334, the locking shaft 376 may extend away from the base end 337 of the carbide assembly so that the insert 340 may be disposed around the locking shaft 376 and positioned intermediate the locking head 372 and the first end 363 of the shank 360.

The insert 340 may comprise a breadth 344 that is larger than an opening 338 of the extension cavity 334. In such embodiments the insert 340 may compress to have a smaller breadth than the opening 338. Once the insert 340 is past the opening 338, the insert 340 may expand to comprise its original or substantially original breadth 344. With both the insert 340 and the locking head 372 inside the extension cavity 334, the first end 363 of the shank 360 may be inserted into the cavity 334 of the carbide extension 330. Once the entire first end 363 of the shank 360 is inserted into the extension cavity 334 to a desired depth, a nut 382 may be threaded onto an exposed end 378 of the locking shaft 376 until the nut 382 contacts a ledge 366 formed within the shank cavity 364 and proximate the bore 362 and mechanically connects the locking mechanism 370 to the shank 360. This contact and further threading of the nut 382 on the locking shaft 376 may cause the locking shaft 376 to move toward the second end 367 of the shank 360 in a direction parallel to the longitudinal central axis 312 of the degradation assembly 310. This may also result in bringing the radially-extending catch 374 of the locking head 372 into contact with the insert 340, and bringing the insert 340 into contact with the inwardly-protruding lip or catch 336 of the extension cavity 334.

382 is an embodiment of a tensioning mechanism 380. The tensioning mechanism 380 is adapted to apply a rearward force on the locking head 362 of the locking mechanism 360 as the first end 363 of the shank 360 pushes in the opposite direction to apply tension along a length of the locking shaft 376. In some embodiments the tensioning mechanism 380 may comprise a press fit, a taper, and/or a nut 382.

Once the nut 382 is threaded tightly onto the locking shaft 376, the locking head 372 and insert 340 are together too wide to exit the opening 338 of the cavity 334. In some embodiments the contact between the locking head 372 and the carbide extension 330 via the insert 340 may be sufficient to prevent both rotation of the working portion 315 about the central axis 312 and movement of the working portion in a direction parallel to the central axis 312. In some embodiments the locking mechanism 370 is also adapted to induce the release of the shank 360 from attachment with the carbide extension 330 by removing the nut 382 from the locking shaft 376.

In some embodiments the insert 340 may be a snap ring. The insert 340 may comprise stainless steel and may be deformed by the pressure of the locking head 372 being pulled towards the second end 367 of the shank 330. As the insert 340 deforms it may become harder. The deformation may also cause the insert 340 to be complementary to both the inwardly-protruding lip 336 and the radially-extending catch 374. This dually complementary insert 340 may avoid point loading or uneven loading, thereby equally distributing contact stresses. In such embodiments the insert 340 may be inserted when it is comparatively soft, and then may be work hardened while in place between the catches 336, 374.

In some embodiments at least part of the shank assembly 350 of the degradation assembly 310 may also be cold worked. The locking mechanism 370 may be stretched to a critical point just before the strength of the locking mechanism 370 is compromised. In some embodiments, the locking shaft 376, locking head 372, and insert 340 may all be cold worked by tightening the nut 382 until the locking shaft and head 376, 372, and the insert 340, reach a stretching critical point. During this stretching the insert 340, the locking shaft 376 and the locking head 372, may all deform to create a complementary engagement, and may then be hardened in that complementary engagement. In some embodiments the complementary engagement may result in an interlocking or engagement between the radially-extending catch or lip 336 and the inwardly-protruding lip or catch 374.

In the embodiment 310 of FIG. 4, both the inwardly-protruding catch 374 and the radially-extending lip or catch 336 are tapers. Also in FIG. 4, the lower portion 332 of the cavity 334 nearest the base end 406 of the carbide extension 330 comprises a uniform inward taper.

Figure 5:
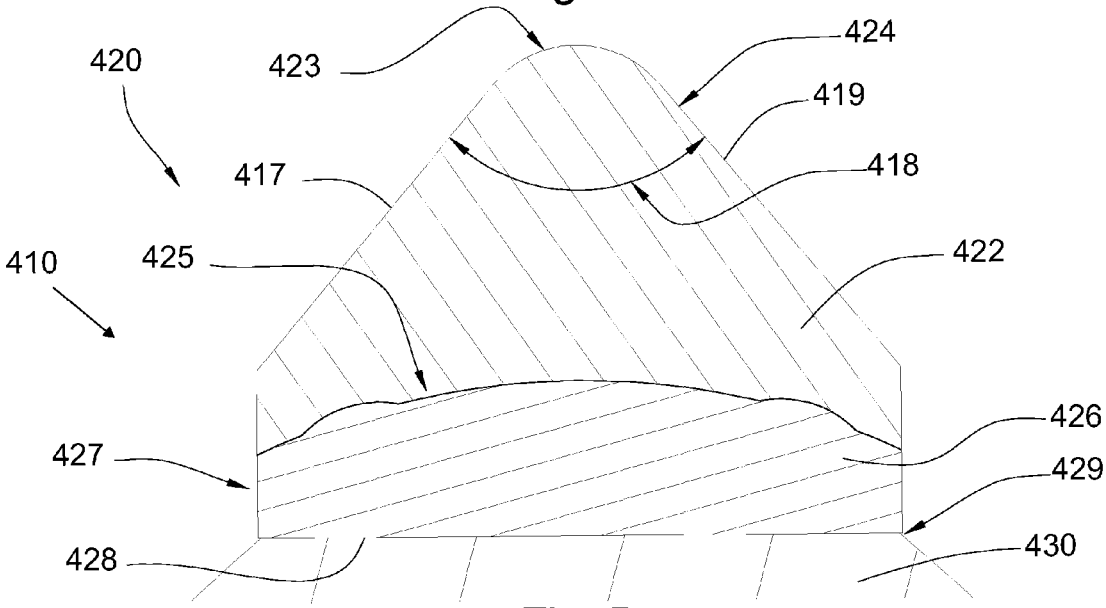
FIG. 5 is a cross-sectional diagram of an embodiment of an impact tip.

Referring now to FIG. 5, the impact tip 420 of another embodiment of the degradation assembly 410 comprises the superhard material 422 bonded to the carbide substrate 426. The superhard material 422 comprises a volume greater than a volume of the carbide substrate 422. In some embodiments the superhard material 422 may comprise a volume that is 75% to 175% of a volume of the carbide substrate 426.

422 and comprises a substantially conical geometry with an apex 423. Preferably, the interface 425 between the substrate 426 and the superhard material 422 is non-planar, which may help distribute loads on the tip 420 across a larger area of the interface 425. At the interface 425 the substrate 426 may comprise a tapered surface starting from a cylindrical rim 427 of the substrate 426 and ending at an elevated flatted central region formed in the substrate 426. The flatted central region may have a diameter of 0.20 to 0.60 percent of a diameter of the cylindrical rim 427.

A thickness of the superhard material from the apex 423 to the non-planar interface 425 is at least 1.5 times a thickness of the substrate 426 from the non-planar interface 425 to its base 428. In some embodiments the thickness of the superhard material from the apex 423 to the non-planar interface 425 may be at least 2.0 times a thickness of the substrate 426 from the non-planar interface to its base 428. The substrate 426 may comprise a thickness of 0.30 to 0.65 times the thickness of the superhard material 422. In some embodiments, the thickness of the substrate is less than 0.100 inches, preferably less than 0.060 inches. The thickness from the apex 423 to the non-planar interface 425 may be 0.190 to 0.290 inches. Together, the superhard material 422 and the substrate 426 may comprise a total thickness of 0.200 to 0.500 inches from the apex 423 to the base of the substrate 428.

The superhard material 422 bonded to the substrate 426 may comprise a substantially conical geometry with an apex 423 comprising a 0.065 to 0.095 inch radius. The substantially conical geometry comprises a first side 417 that may form a 50 to 80 degree included angle 418 with a second side 419 of the substantially conical geometry. In asphalt milling applications, the inventors have discovered that an optimal included angle is 45 degrees, whereas in mining applications the inventors have discovered that an optimal included angle is between 35 and 40 degrees. The impact tip 420 may comprise an included angle 418 to the thickness from the apex 423 to the non-planar interface 425 having a ratio of 240 to 440. The tip 423 may comprise an included angle 418 to a total thickness from the apex 423 to a base 428 of the substrate 426 having a ratio of 160 to 280. A tip that maybe compatible with the present invention is disclosed in pending U.S. patent application Ser. No. 11/673,634 to Hall.

The superhard material 422 may be a material selected from the group consisting of diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. The superhard material 422 may also comprise infiltrated diamond. The superhard material 422 may comprise an average diamond grain size of 1.0 to 100.0 microns. The superhard material 422 may comprise a monolayer of diamond. For the purpose of this patent the word monolayer is defined herein as a singular continuous layer of a material of indefinite thickness.

The superhard material 422 may comprise a metal catalyst concentration of less than 5 percent by volume. The superhard material 422 may be leached of a catalyzing material to a depth of no greater than at least 0.5 mm from a working surface 424 of the superhard material 422. A description of leaching and its benefits is disclosed in U.S. Pat. No. 6,562,462 to Griffin et al., which is herein incorporated by reference for all that it contains. Isolated pockets of catalyzing material may exist in the leached region of the superhard material 422. The depth of at least 0.1 mm from the working surface 424 may comprise a catalyzing material concentration of 1 percent to 5 percent by volume.

The impact tip 420 may be brazed onto the working end of the carbide extension 430 at a braze interface 429. Braze material used to braze the tip 420 to the carbide extension 430 may comprise a melting temperature from 700 to 1200 degrees Celsius; preferably the melting temperature is from 800 to 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material may comprise 30 to 62 weight percent palladium, preferable 40 to 50 weight percent palladium. Additionally, the braze material may comprise 30 to 60 weight percent nickel, and 3 to 15 weight percent silicon; preferably the braze material may comprise 47.2 weight percent nickel, 46.7 weight percent palladium, and 6.1 weight percent silicon.

cooling during brazing may be critical in some embodiments, since the heat from brazing may leave some residual stress in the bond between the carbide substrate 426 and the superhard material 422. The farther away the super hard material 422 is from the braze interface 429, the less thermal damage is likely to occur during brazing. Increasing the distance between the brazing interface 429 and the superhard material 422, however, may increase the moment on the carbide substrate 426 and increase stresses at the brazing interface 429 upon impact.

Figure 6:
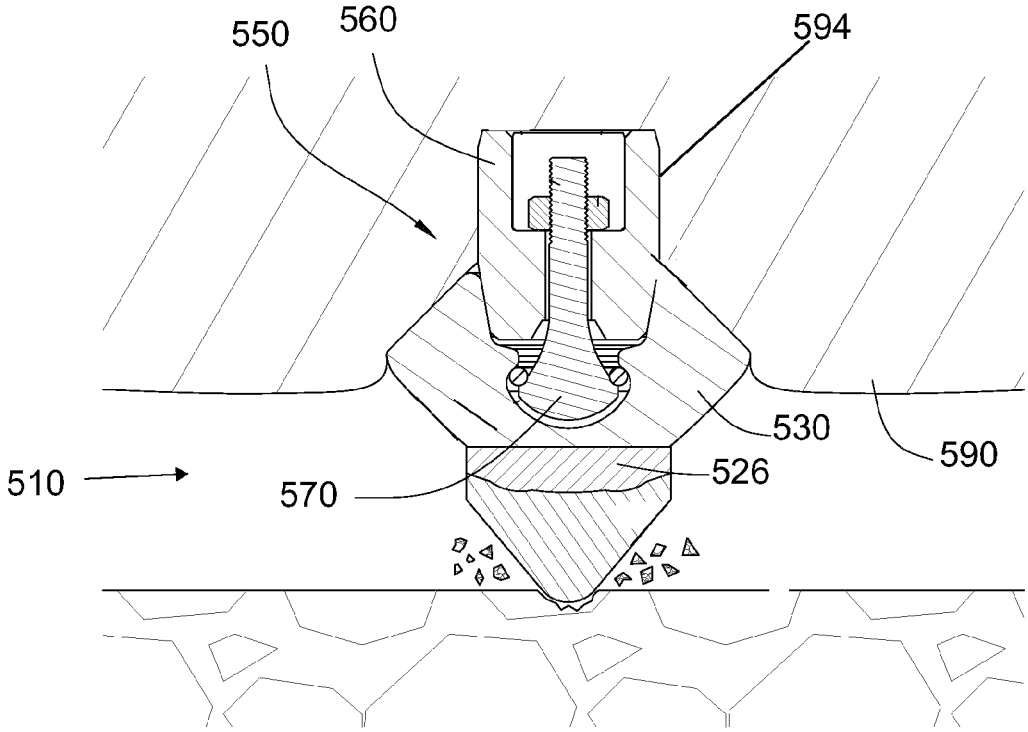
FIG. 6 is a cross-sectional diagram of another embodiment of a degradation assembly.
Figure 7:
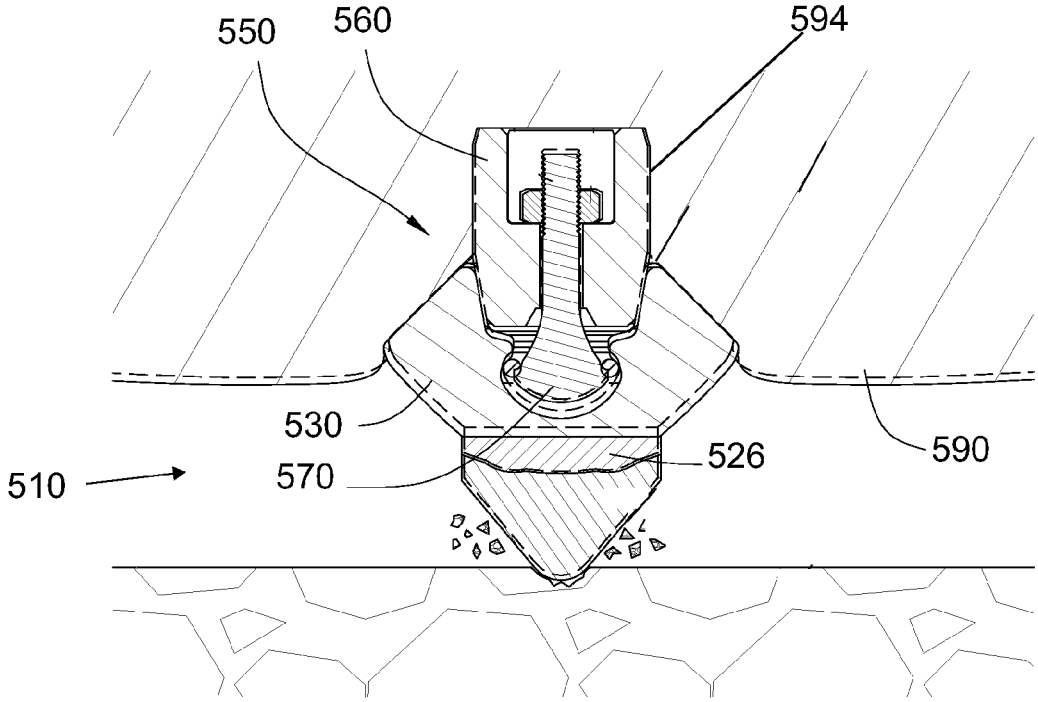
FIG. 7 is a cross-sectional diagram of another embodiment of a degradation assembly.

The shank assembly may be press fitted into the base end of the carbide extension 430 before or after the impact tip 420 is brazed onto the working end of the carbide extension 430.

another embodiment of the degradation assembly 510 illustrated in FIGS. 6 and 7, the shank 560 of the shank assembly 550 may be press-fit into the recess 594 formed in the driving mechanism 590. The shank 560 of the shank assembly 550 has a coefficient of thermal expansion within 25 percent of a coefficient of thermal expansion of a material of the driving mechanism 590. It is believed that if the coefficient of thermal expansion of the shank 560 is within 25 percent of the coefficient of thermal expansion of the driving mechanism 590 that the press-fit connection between the shank 560 and the driving mechanism 590 will not be compromised as the driving mechanism 590 increases in temperature due to friction or working conditions. It is believed that if the coefficients of thermal expansion are outside of 25 percent that the shank assemblies 550 will loose their press fit and potentially fall out of the driving mechanism 590. In the preferred embodiment, the coefficients of thermal expansion are within 10 percent.

570 may comprise a coefficient of thermal expansion equal to or less than the coefficient of thermal expansion of the shank 560. The benefits of similar coefficients allow for a more optimized press fit.

The carbide substrate 526 may have the same coefficient of thermal expansion as the carbide extension 530.

Figure 8:
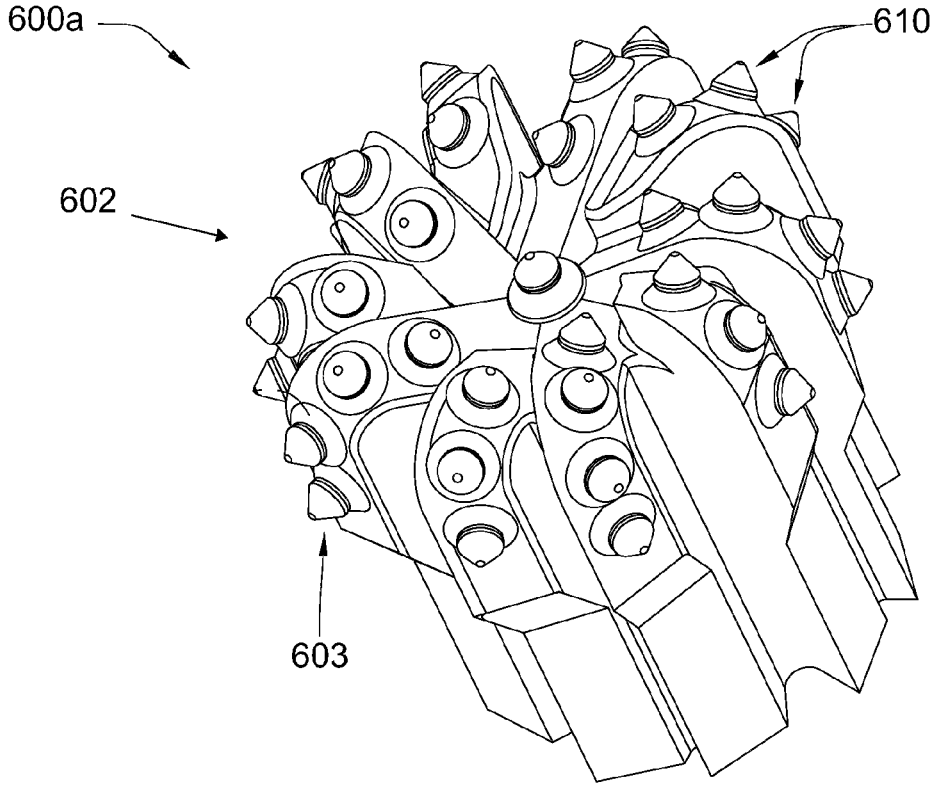
FIG. 8 is a perspective diagram of another embodiment of a rotary drag bit.
Figure 9:
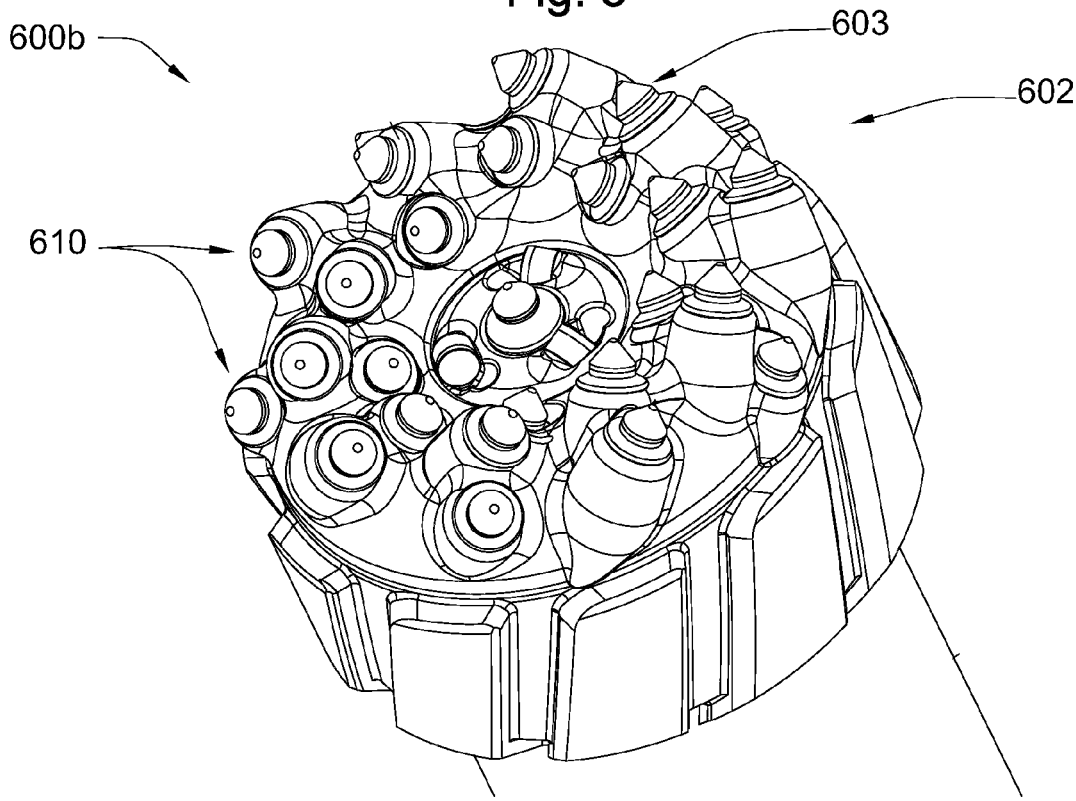
FIG. 9 is a perspective diagram of another embodiment of a rotary drag bit.
Figure 10:
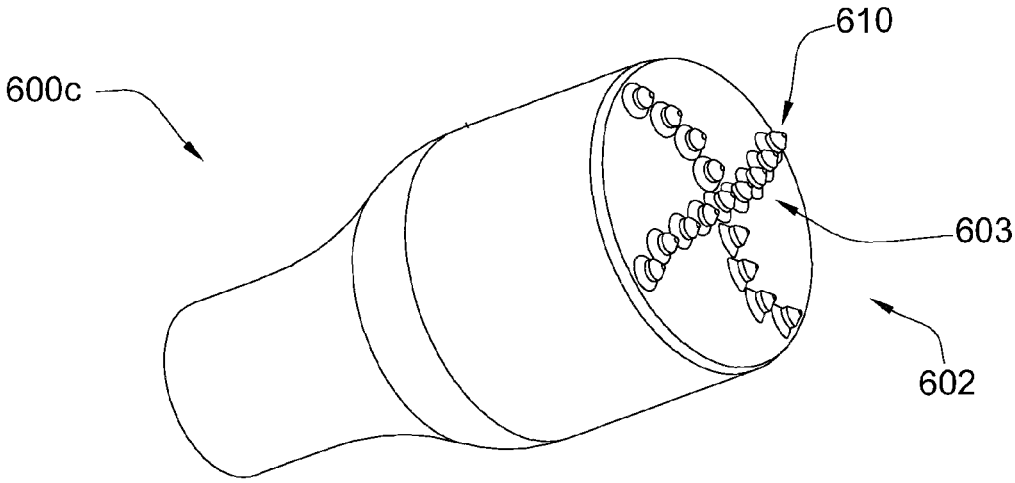
FIG. 10 is a perspective diagram of another embodiment of a rotary drag bit.
Figure 11:
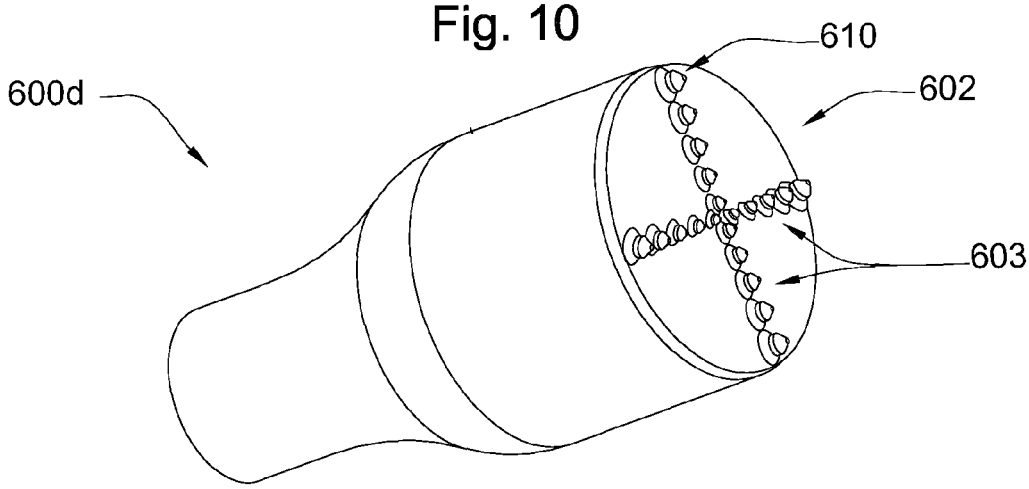
FIG. 11 is a perspective diagram of another embodiment of a rotary drag bit.
Figure 12:
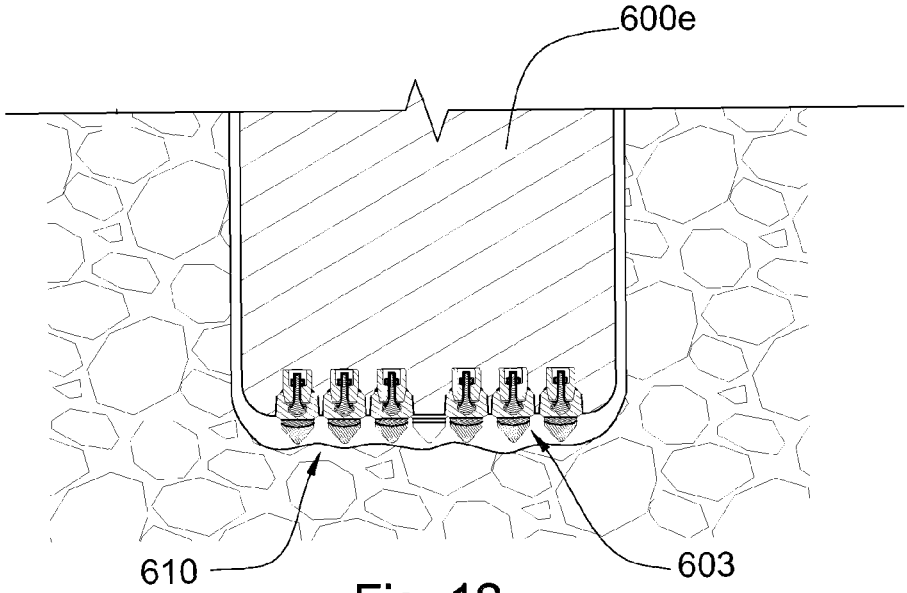
FIG. 12 is a cross-sectional diagram of another embodiment of a rotary drag bit.

FIGS. 8 through 12 disclose various embodiments of a rotary drag bit 600A-600E, each comprising at least one degradation assembly. FIG. 8 discloses a rotary drag bit 600A that may comprise ten blades 603A formed in the working face 602A of the drill bit 600A, and wherein the carbide extensions 610A may form a portion of the blades 603A and working face 602A of the bit. Alternatively, the blades 603B, 603C, 603D, 603E may be formed by the degradation assemblies 610B, 610C, 610D, 610E in the working faces 602B, 602C, 602D, 602E of the drill bits 600B, 600C, 600D, 600E, respectively, such as disclosed in FIGS. 9 through 12, respectively. The drill bit may also comprise degradation assemblies 610A-610E of varying sizes.

Figure 13:
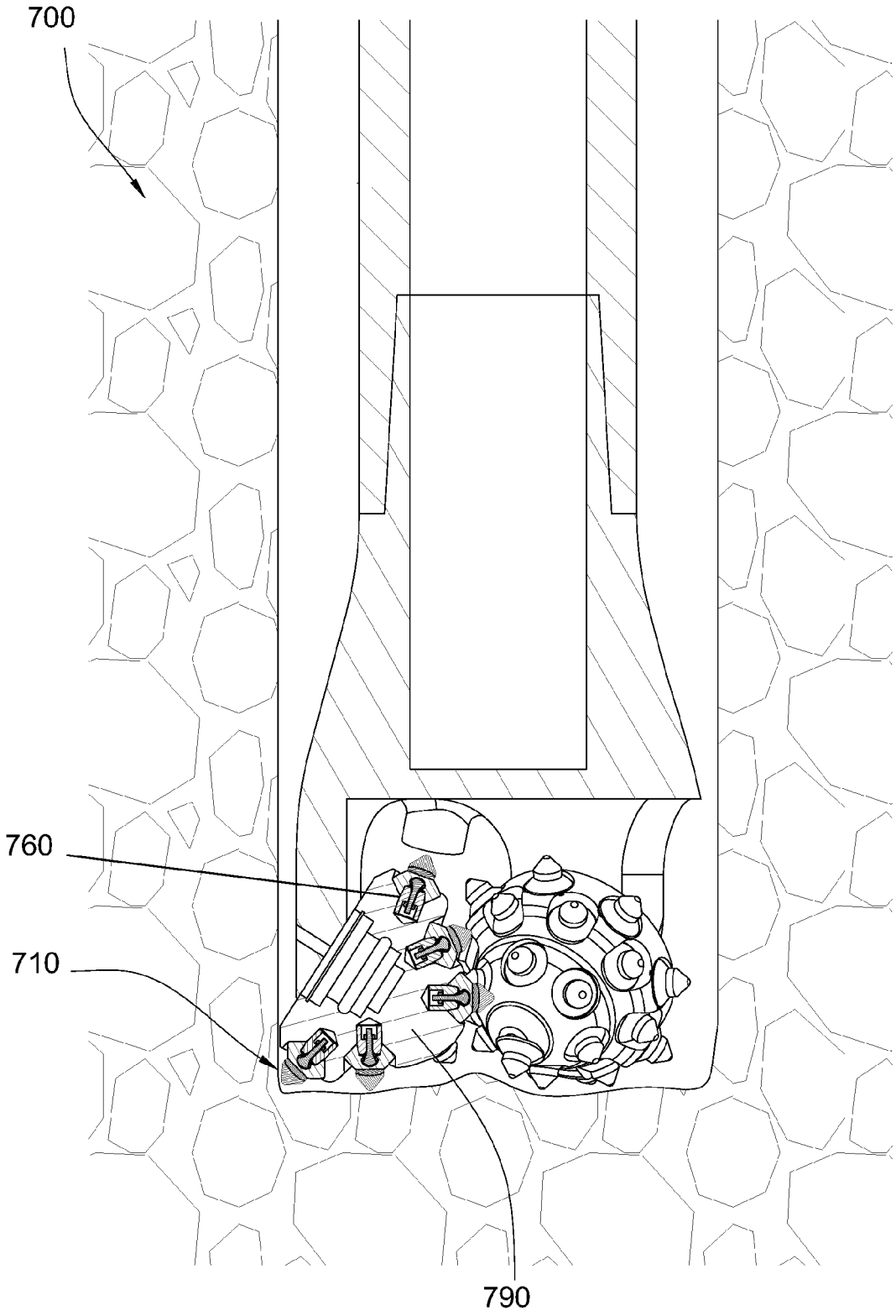
FIG. 13 is a cross-sectional diagram of an embodiment of a roller cone bit.

FIG. 13 discloses an embodiment of the degradation assembly 710 incorporated into a roller cone bit 700. The shank 760 of the degradation assembly 710 may be press-fitted into a recess formed in the cone 790 of the roller cone bit 700. The cone 790 may comprise multiple degradation assemblies 710.

Figure 14:
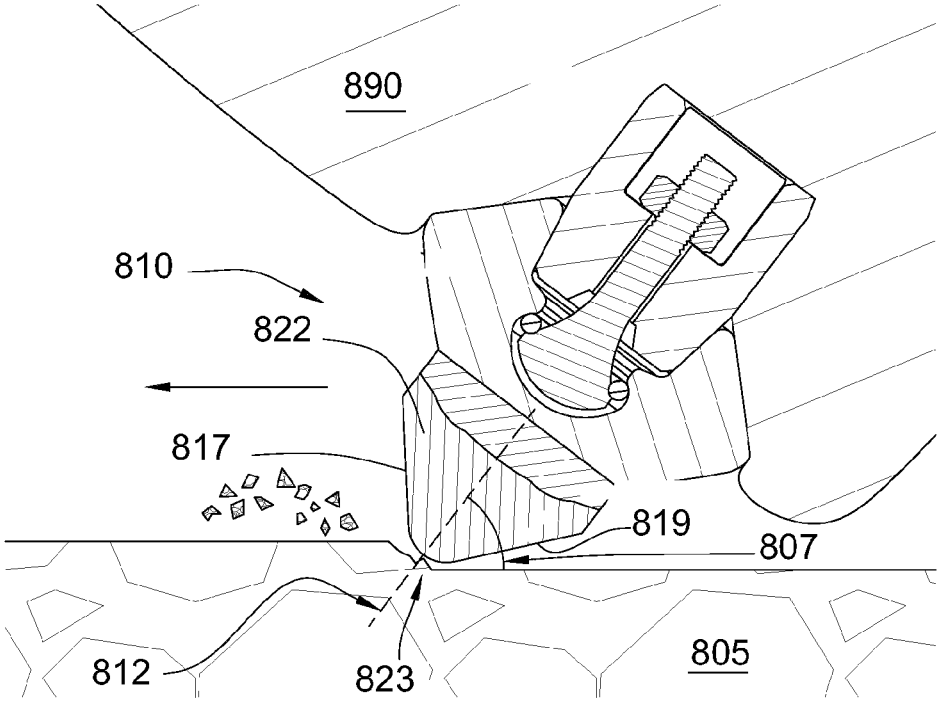
FIG. 14 is a cross-sectional diagram of another embodiment of a degradation assembly.

FIG. 14 discloses an embodiment of the degradation assembly 810A adapted to a rotary drag drill bit where the apex 823A contacts the formation 805A at an angle 807A with the central axis 812A. The angle 807A may always be larger than half the included angle 418 discussed in FIG. 5. The degradation assembly 810A may be positioned on the driving mechanism 890A such that apex 823A of the superhard material 822A engages the formation 805A and the sides 817A, 819A of the superhard material 822A do not engage or contact the formation 805A.

Figure 15:
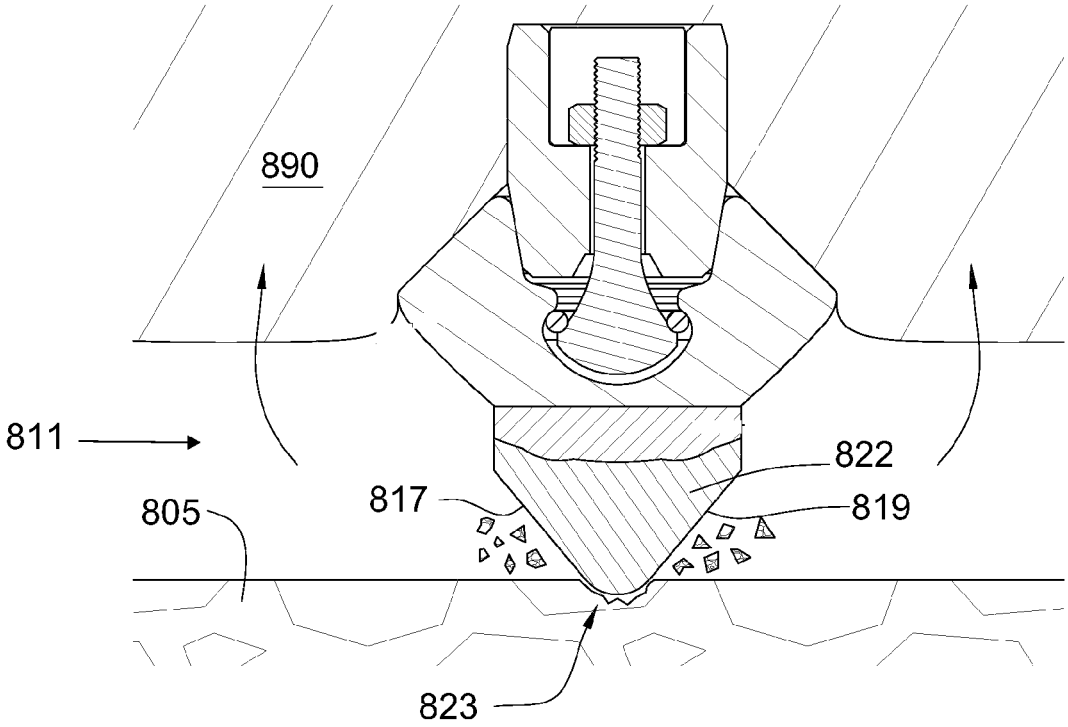
FIG. 15 is a cross-sectional diagram of another embodiment of a degradation assembly.

FIG. 15 discloses an embodiment of the degradation assembly 810B adapted to a roller cone bit. The degradation assembly 810B may be positioned on the driving mechanism 890B such that apex 823B of the superhard material 822B engages the formation 805B and that no more than 10 percent of the sides 817B, 819B of the superhard material 822B engages or contacts the formation 805B. It is believed that the working life of the degradation assembly 810B may be increased as contact between the sides 817B, 819B of the superhard material 822B and the formation 805B is minimized.

Figure 16:
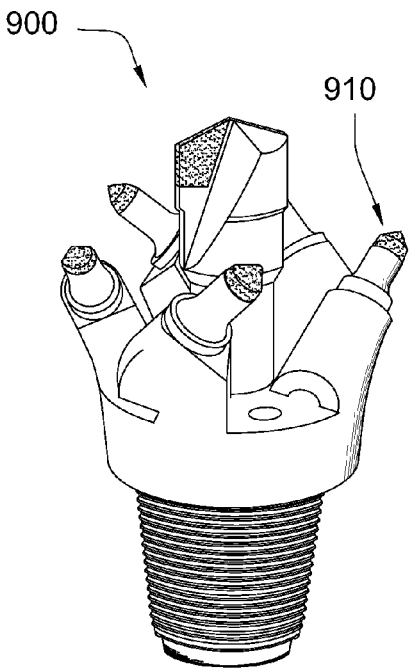
FIG. 16 is a perspective diagram of an embodiment of a drill bit.
Figure 17:
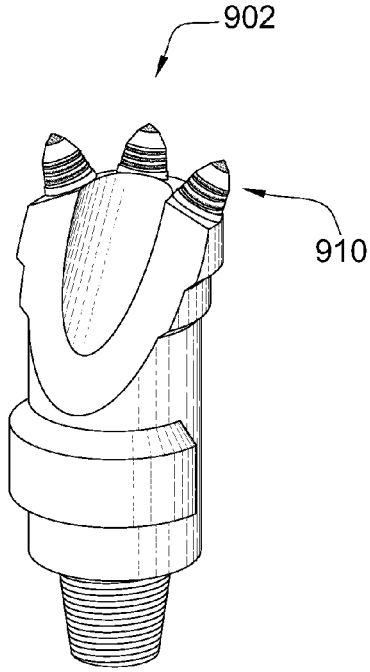
FIG. 17 is a sectioned, perspective diagram of another embodiment of a drill bit.
Figure 18:
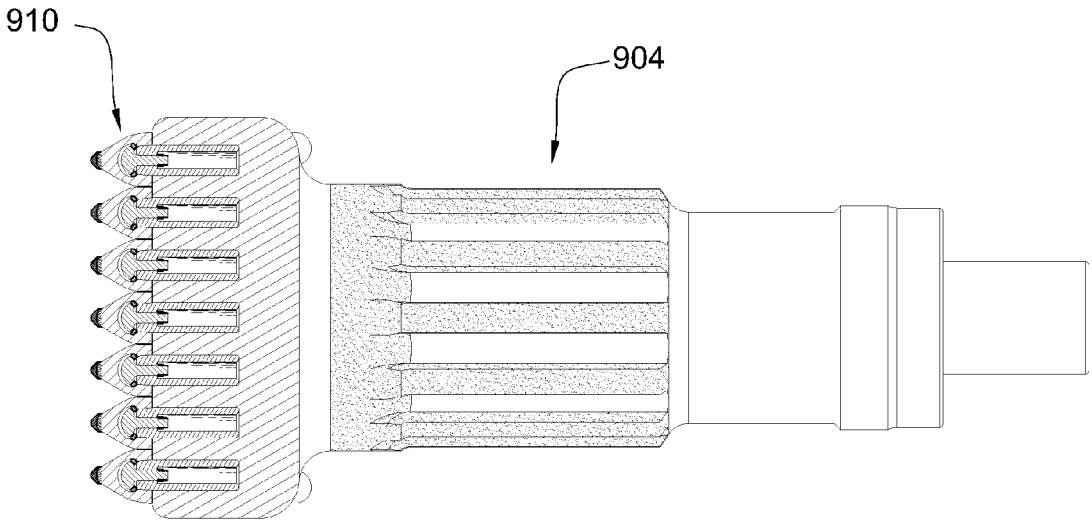
FIG. 18 is a cross-sectional diagram of an embodiment of a percussion bit.

FIGS. 16-18 disclose various additional drilling applications that may incorporate the degradation assembly of the present invention. FIG. 16 discloses a drill bit 900A typically used in water well drilling that includes degradation assembly 910A.

FIG. 17 discloses a drill bit 900B typically used in subterranean, horizontal drilling that includes degradation assembly 910B.

FIG. 18 discloses a percussion bit 900C typically used in downhole subterranean drilling that includes degradation assembly 910C.

Figure 19:
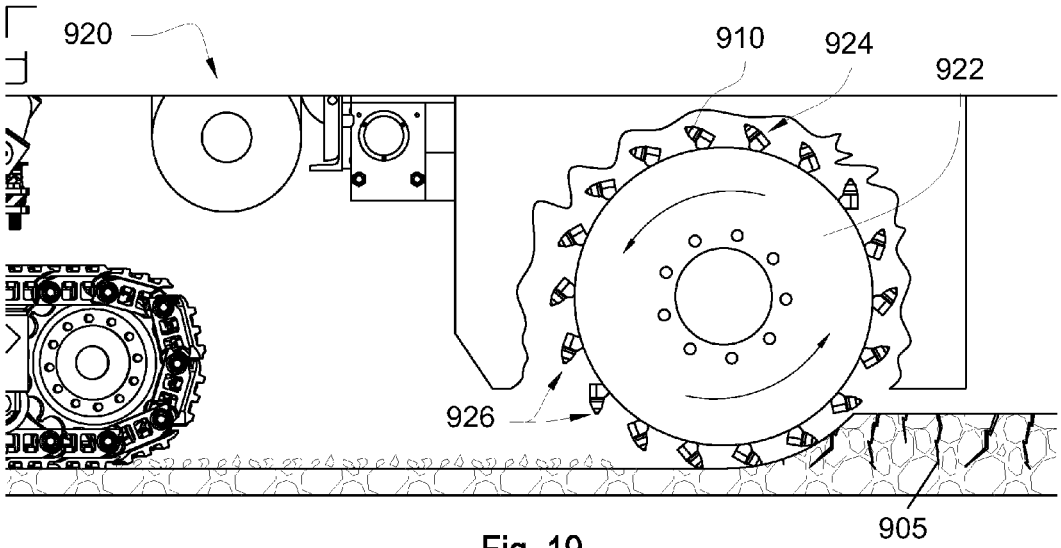
FIG. 19 is a schematic diagram of an embodiment of a milling machine.
Figure 20:
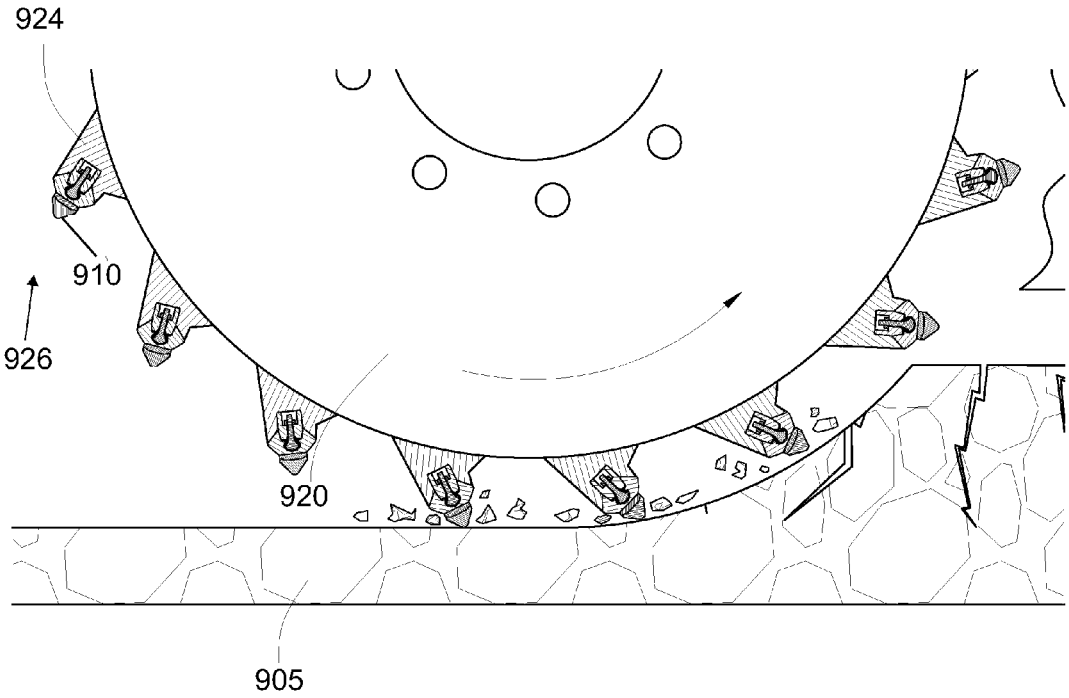
FIG. 20 is a cross-sectional diagram of an embodiment of a milling machine drum.

Referring now to FIGS. 19 through 20, the degradation assembly 1010 may be incorporated into a plurality of picks 1026 attached to a rotating drum 1022 that may be connected to the underside of a pavement milling machine 1020. The milling machine 1020 may be a cold planer used to degrade man-made formations such as a paved surface 1005 prior to the placement of a new layer of pavement. Picks 1026 may be attached to the rotating drum or driving mechanism 1022 bringing the picks 1026 into engagement with the formation 1005. The pick 1026 may include a degradation assembly 1010 and a holder 1024, which may be a block, an extension in the block or a combination thereof. The holder 1024 is attached to the driving mechanism 1022, and the degradation assembly 1010 is inserted into the holder 1024. The holder 1024 may hold the degradation assembly 1010 at an angle offset from the direction of rotation, such that the pick 1026 engages the pavement at a preferential angle. Each pick 1026 may be designed for high-impact resistance and long life while milling the paved surface 1005. A pick that may be compatible with the present invention is disclosed in pending U.S. patent application Ser. No. 12/020,924 to Hall. The degradation assembly 1010 may also be incorporated in mining picks, trenching picks, excavating picks or combinations thereof.

Whereas the present invention has been described in particular relation to the drawings attached hereto, it should be understood that other and further modifications apart from those shown or suggested herein, may be made within the scope and spirit of the present invention.

What is claimed is:

1. A degradation assembly for use with a driving mechanism, the degradation assembly comprising:

a working portion including an impact tip attached to a working end of a carbide extension, the carbide extension having a cavity formed in a base end, the cavity being adapted to interlock with a shank assembly of the cutting element assembly; and a shank assembly including:

a shank having a first end and a second end opposite the first end, the shank having a first outer surface proximate the first end being receivable into the cavity of the carbide extension, and a second outer surface proximate the second end being receivable into a recess of a driving mechanism with a press fit to secure the shank to the driving mechanism; and a locking mechanism slidably supported within a bore of the shank, the locking mechanism having a locking head projecting from the first end of the shank and a locking shaft extending away from the locking head towards the second end of the shank, the locking head having a radially-extending catch configured to engage with the cavity to couple the shank assembly to the working portion.

2. The degradation assembly of claim 1, wherein the cavity comprises an inwardly-protruding lip.

3. The degradation assembly of claim 2, wherein the inwardly-protruding lip of the cavity is engagable with the radially-extending catch of the locking head.

4. The assembly of claim 2, further comprising an insert positioned between the inwardly protruding catch and the radially extending catch.

5. The degradation assembly of claim 4, wherein the insert is selected from the group consisting of a rigid ring, a snap ring, a split ring, a coiled ring, a flexible ring, an elastomeric ring, a spring, a plurality of arc segments, a plurality of wedges, a plurality of shims, and a plurality of balls.

6. The degradation assembly of claim 1, wherein the carbide extension is selected from the group consisting of a drill bit blade, a drill bit working surface and a pick bolster.

7. The degradation assembly of claim 1, wherein the locking shaft is mechanically associated with a tensioning mechanism positioned adjacent the bore and proximate the second end of the shank.

8. The degradation assembly of claim 7, wherein activating the tensioning mechanism applies tension along a length of the locking shaft.

9. The degradation assembly of claim 1, wherein the locking mechanism comprises a coefficient of thermal expansion equal to or less than the coefficient of thermal expansion of the shank.

10. The degradation assembly of claim 1, wherein the impact tip further comprises a superhard material bonded to a cemented metal carbide substrate at a non-planar interface.

11. The degradation assembly of claim 10, wherein the cemented metal carbide substrate is brazed to the working end of the carbide extension.

12. The degradation assembly of claim 10, wherein the cemented metal carbide substrate has a thickness of 0.30 to 0.65 times a thickness of the superhard material, as measured along a centerline axis of the degradation assembly.

13. The degradation assembly of claim 1, wherein the shank and locking mechanism are formed from hardened materials selected from the group consisting of steel, stainless steel and hardened steel.

14. A degradation assembly for use with a driving mechanism, said degradation assembly comprising:

a carbide extension having a working end, a base end, and an extension cavity formed in said base end;

an impact tip attached to said working end;

a shank having a first end for insertion into said extension cavity and a second end opposite said first end for being press fit into a recess of said driving mechanism, said shank having a shank cavity formed at said second end and a bore extending from said shank cavity to said first end; and a locking mechanism including:

a shaft extending from said shank cavity through said bore to said first end of said shank;

a locking head attached to said shaft configured to fit in said extension cavity;

a radially-extending catch mechanically associated with said locking head configured to engage with said cavity; and a tensioning mechanism for mechanical association with said shaft to tension said locking mechanism and lock said carbide extension to said first end of said shank.

15. The degradation assembly of claim 14 wherein said impact tip is brazed to said carbide extension.

16. The degradation assembly of claim 14, wherein said extension cavity comprises an inwardly-protruding lip.

17. The degradation assembly of claim 16, wherein said inwardly-protruding lip of said extension cavity is engagable with said radially-extending catch of said locking head.

18. The degradation assembly of claim 16, further comprising an insert positioned between said inwardly-protruding lip and said radially-extending catch.

19. The degradation assembly of claim 18, wherein said insert is selected from said group consisting of a rigid ring, a snap ring, a split ring, a coiled ring, a flexible ring, an elastomeric ring, a spring, a plurality of arc segments, a plurality of wedges, a plurality of shims, and a plurality of balls.

20. A degradation assembly for use with a driving mechanism, said degradation assembly comprising:

a working portion including an impact tip attached to a working end of a carbide extension, said carbide extension having a cavity formed in a base end opposite said working end;

a shank having a first end, a second end opposite said first end and a bore extending from said first end to said second end, said first end being sized and shaped for insertion into said cavity, said second end being sized and shaped for being press fit into a recess of said driving mechanism; and a locking mechanism including a locking head formed at one end of a locking shaft, said locking shaft being slidably inserted within said bore with said locking head proximate said first end of said shank and said locking shaft extending away from the locking head towards said second end of said shank, and said locking head having a radially-extending catch configured to engage with said cavity to couple said working portion to said shank.

21. The degradation assembly of claim 20, further comprising a lock proximate said second end of said shank for mechanical association with said locking shaft to secure said locking mechanism to said shank.

* * * * *

UNITED STATES PATENT AND TRADEMARK OFFICE

CERTIFICATE OF CORRECTION

PATENT NO. : 7,963,617 B2
APPLICATION NO. : 12/051689
DATED : June 21, 2011
INVENTOR(S) : David R. Hall, Ronald Crockett and Scott Dahlgren It is certified that error appears in the above-identified patent and that said Letters Patent is hereby corrected as shown below:

On the Title Page:

In the section entitled "Related U.S. Application Data", the line reading as follows:

"11/965,672, filed on Dec. 27, 2007, which is a"

should be replaced with the following line:

"11/695,672, filed on April 3, 2007, which is a".

Signed and Sealed this
Eighteenth Day of October, 2011

David J. Kappos

David J. Kappos
*Director of the United States Patent and Trademark Office*